United States Patent [19]

Jansz

[11] 4,045,969

[45] Sept. 6, 1977

[54] SUBMERGIBLE PILE DRIVING METHOD AND APPARATUS FOR CONTINUOUS OPERATION

[75] Inventor: Joost W. Jansz, The Hague, Netherlands

[73] Assignee: Hollandsche Beton Groep N. V., Rijswijk, Netherlands

[21] Appl. No.: 681,944

[22] Filed: Apr. 30, 1976

[30] Foreign Application Priority Data

Oct. 13, 1975 Netherlands ..... 7512023

[51] Int. Cl.[2] ..... E02D 7/00

[52] U.S. Cl. ..... 61/535; 173/1; 173/92

[58] Field of Search ..... 61/53.5, 63; 173/DIG. 1, 92, 103, 112; 175/6

[56] References Cited

U.S. PATENT DOCUMENTS 2,583,965 1/1952 Page, Jr. et al. ..... 175/6

2,904,964 9/1959 Kupka ..... 173/DIG. 1

*Primary Examiner*—Jacob Shapiro

*Attorney, Agent, or Firm*—Sughrue, Rothwell, Mion, Zinn and Macpeak

[57] ABSTRACT

A submergible pile driving apparatus is suspended from a string of rigid tubes 12 to minimize twisting during operation, and the tubes also carry conduits 18, 19 for transmitting hydraulic, pneumatic and electrical power to the apparatus. The upper connections to the conduits are via flexible hoses 25, 26 through a coupling piece 20 inserted in the string below its point of suspension at eye 13, and the lengths of the hoses are adapted to the length of the pile 7 to be driven, whereby continuous operation is possible. That is, locking beams 16 may be engaged with a tube flange to take up the weight of the suspended string and apparatus while a further tube is added to the upper end of the string, without interrupting the driving operation.

9 Claims, 4 Drawing Figures

SUBMERGIBLE PILE DRIVING METHOD AND APPARATUS FOR CONTINUOUS OPERATION

BACKGROUND OF THE INVENTION

1. Field of the Invention

This invention relates in general to a method and apparatus for subaqueous pile driving at considerable depths, and more specifically comprises a ship equipped with a lifting crane and a pile driving head, said head being vertically reciprocable in a subframe coupled to the crane. The pile driving apparatus is guided on cables connected to the pile and running downwards from the ship.

2. Description of the Prior Art

Copending application Ser. No. 588,554 filed on June 19, 1975 and now U.S. Pat. No. 3,998,064 discloses a submergible pile driving apparatus in which the subframe acts as a means to keep the pile in an upright position at the beginning of the pile driving process. The subframe is guided on the pile, the pile driving head is guided in the subframe, and the subframe is suspended from the lifting crane by means of a cable. In addition, the subframe and the pile driving head are guided on cables connected to the pile, said cables serving as a guide during the lowering of the pile driving head and the subframe onto the pile head. During the process of pile driving, however, the cables no longer serve as a guide and are slack and relieved from stress, so that they are not affected by impact loads that occur during the pile driving process.

During submerged pile driving the pile driving head must be supplied with hydraulic energy for its operation, and there should be a hydraulic return line. Electric lines are also required for carrying out measurements which may be read on the ship so that the personnel in charge can properly monitor and control the operation. Underwater television may be provided, and compressed air must be supplied to the casing embracing the pile driving device to provide air in the region where the ram strikes the head of the pile. At a considerable driving depth this means that considerable lengths of several hoses have to be lowered, which not only requires large reels with a full stock of hoses but results in the hoses easily becoming entangled. Further, the cable on which the pile driving apparatus is suspended is flexible and presents an obstruction over a considerable portion of its length. The flexible cable also permits the pile driving apparatus to rotate about the vertical axis, which increases the problems that already exist with hoses.

SUMMARY OF THE INVENTION

In the present invention the subframe is connected to the hoisting device by sections of torsionally rigid tubing, which also serve as carriers for the supply lines of hydraulic energy, compressed air, electricity and the like, running from the ship to the hoisting device. The lines between the subframe and pile driving head consist of short hose lengths, and hoses are also present between the ship and a point on the tube string. This point lies below the point of suspension of the string on the hoisting device, and the length of these upper hoses is adapted to the length of the pile to be driven into the ground, such length being at least one half the length of the pile. Since the major part of the distance between the hoisting device and the pile driving apparatus which has been lowered is taken up by a tube string, the drawbacks arising from the tendency of the apparatus to twist and the elasticity of the cable are avoided, since the tube string has a higher torsional stiffness and a substantially lower elasticity in the longitudinal direction.

The various hydraulic, air and electrical lines are also connected to the tube string and are guided therealong so that they are no longer suspended in loose coils. Inasmuch as during the pile driving process relative movement between the subframe and the pile driving head must be possible, short hoses are disposed between the lower end of the tube string and the pile driving head, said hoses having a length depending on the length of the reciprocal movement of the pile driving head.

By using pieces of tubing it is possible to lower the pile driving apparatus in a stepwise manner. This is no disadvantage during the lowering of the pile driving apparatus. During the pile driving process it may be necessary to connect other pieces of tubing as the driving progresses so that sufficient rigidity is maintained over the complete driving range. It is, with this invention, no longer necessary to dispose supply lines and hoses along said additional pieces of tubing because the energy to the pile driving apparatus is supplied continuously via lines permanently secured to the initial tube string sections. Thus, said additional pieces of tubing may be connected without interruption of the pile driving process. By providing hose lengths at the upper end of the tube string adapted to the length of the pile to be driven, i.e., hoses of a length at least half the distance travelled by the pile driving apparatus, it is possible to continue the pile driving without interruption because the energy supply is continuous. This requires the upper hoses to be connected to the tube string at a point below the point of suspension of the string on the hoisting device, the distance from the suspension point at the end of the driving operation corresponding to the length of the pile to be driven, i.e., the distance which must be traversed by the pile driving apparatus. Thus, at the end of the pile driving process the distance between the point of connection of the hoses on the upper part of the tube string and the top of the hoisting device should at least be the same as the length of the hoses and at least the same as the distance to be covered by the pile driving apparatus. The latter distance depends on the length of the pile to be driven into the ground.

The connection between the hoses and the pipelines carried by the tube string preferably consists of a coupling piece included in the tube string in both the upper and the lower sections. The coupling piece may be provided with connecting pieces with stop valves, if necessary, with remote control. This is of particular importance for the hydraulic pressure lines. The stop valves are useful at the upper coupling piece in order to be able to disconnect it without loss of fluid pressure and to ready it for the next operation. In addition, individual measures can be taken for blowing out the lines with pressure fluid, at least the ones running along the tube string, and for bleeding them.

The hoses connecting the upper coupling piece and the apparatus on the ship run preferably over roller paths disposed on either side of the center line of the tube string, and the hoses may be suspended in the water next to the ship without any problem. No reels are required, which simplifies the apparatus.

For the purposes of the invention it is not important whether the pile and pile driving apparatus are lowered simultaneously, or whether the pile is first lowered and subsequently the pile driving apparatus is lowered onto it.

DETAILED DESCRIPTION OF THE PREFERRED EMBODIMENT

Figure 1:
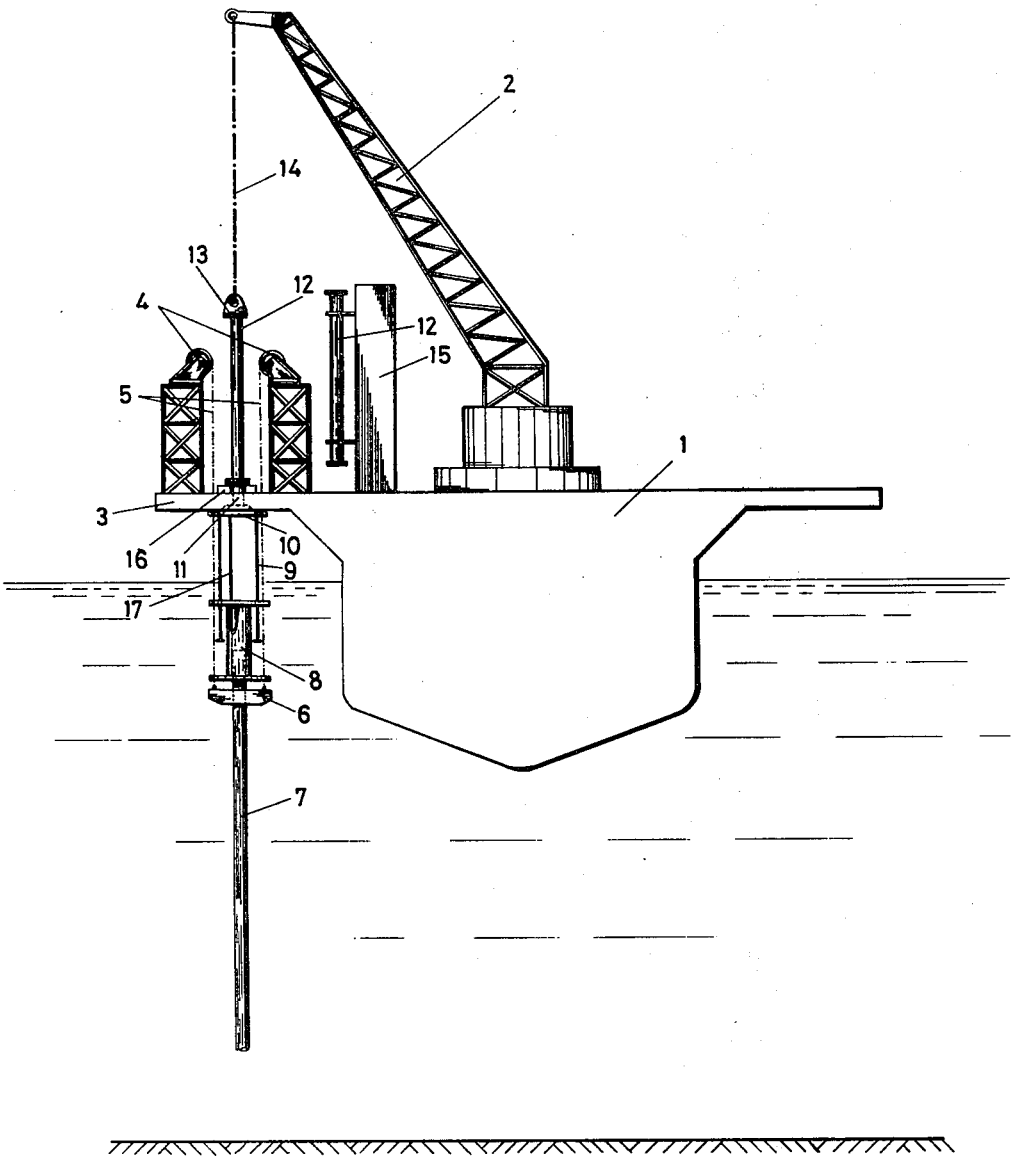
FIG. 1 is a diagrammatic view of the apparatus of the invention preparatory to pile driving.

FIG. 1 shows a ship 1 and a hoisting crane 2, as well as an extended cantilever platform 3 from where the operations take place. The ship carries two winches 4 with cables 5, and a pile 7 is suspended on the cables by means of a disconnectable crossbar 6.

FIG. 1 shows the situation in which the pile has already been slightly lowered and a pile driving apparatus 8 has already been disposed on the head of the pile, said apparatus being slidably guided in the vertical direction in a subframe 9. The subframe is provided with an upper crossbar 10 on which a tube 12 is secured via a coupling piece 11, said tube being suspended on a hoisting cable 14 by means of a detachable eye 13. Reference numeral 15 indicates a rack with tube sections 12. For connecting or detaching a tube section, the tube string is supported at the region of a flange on the cantilever platform 3 by means of movable supporting beams 16. The lowering and lifting of the tube string, thus, takes place in a stepwise manner. One or more hoses or lines 17 are present between the crossbar 10 and the pile driving apparatus 8.

Figure 2:
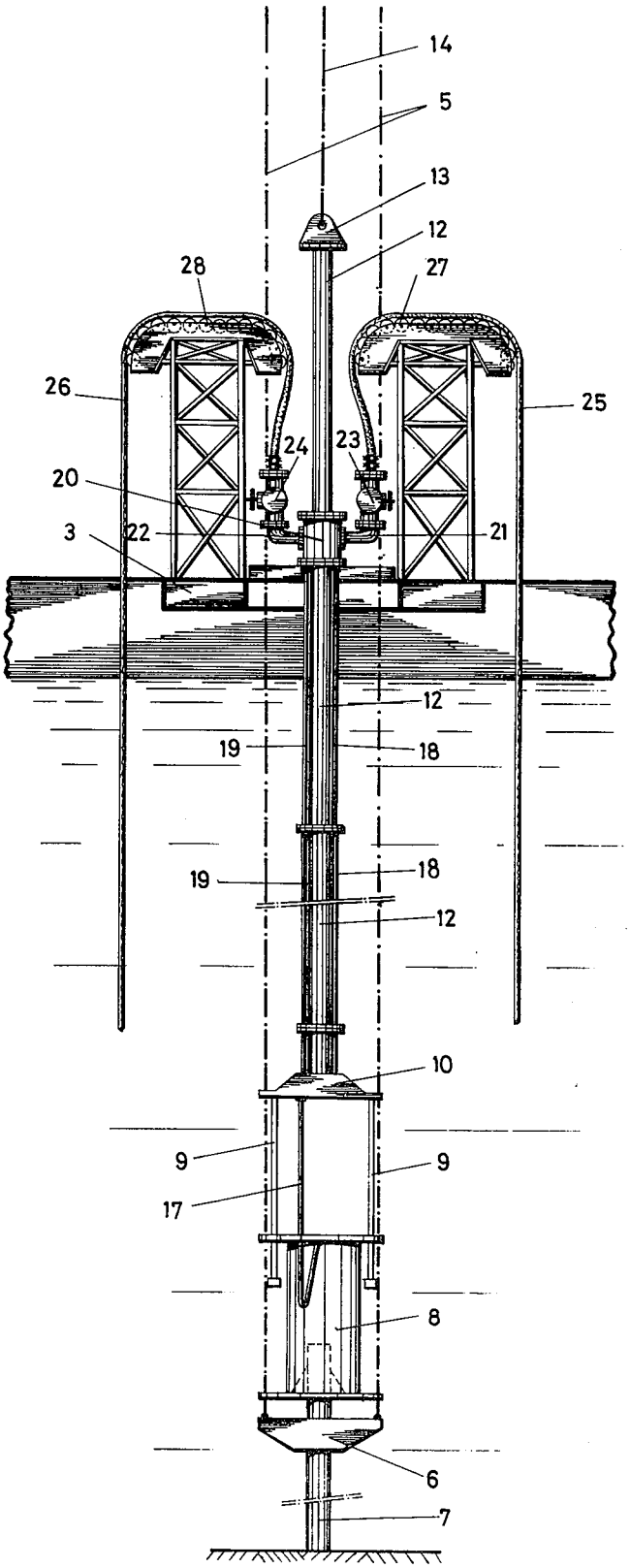
FIG. 2 shows the situation when the pile driving apparatus has been lowered.

FIG. 2 shows the situation at the end of the process of lowering, in which the pile and pile driving apparatus have reached the ocean floor. It can be seen from FIG. 2 that the pile driving apparatus is suspended on a string of tubes 12 by means of subframe 9 and crossbar 10, in which pipelines 18 and 19 run along each piece of tubing. These pipelines may consist of pipe lengths but also of hoses or pieces of hoses clamped on the tube string by means of spring clips or the like. The couplings between the pipelines on the sections of the tube string may be implemented in a variety of ways well known in the art. Such couplings may be made manually as additional tube sections 12 are added to the string, or may be made automatically by male and female coupling members provided in the tube section flanges which mate as the sections are joined.

The upper section of the tube string has a coupling piece 20 with connecting members 21, 22 and closing valves 23, 24 therein. Hoses 25 and 26 are coupled to the connecting members, pass over roller paths 27 and 28, and run downwardly to hang in the water. Their ends are connected to appropriate sources of energy on the ship.

The hoses should have such a length that the pile can be driven into the ground without interruptions, since interruption of the process of pile driving means that when resuming the process again a higher initial resistance has to be overcome, which is time consuming and a waste of energy. Therefore, hoses 25 and 26 should have a length which is related to the distance to be covered by the pile driving apparatus and said distance, again, depends on the length of the pile.

Figures 3, 4:
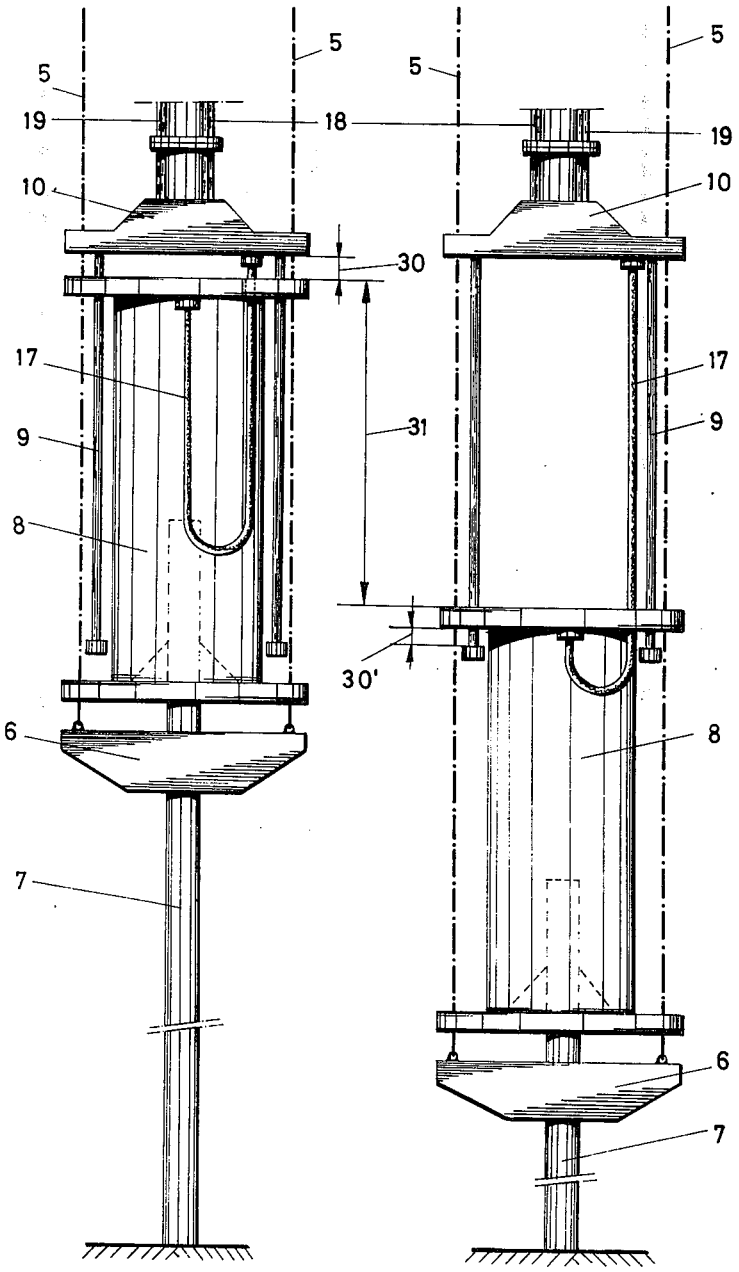
FIGS. 3 and 4 are diagrammatic views of the lower part of FIG. 2 during the process of pile driving.

Whereas FIG. 2 illustrates the position of the subframe and the pile driving apparatus with respect to each other at the end of the process of lowering, FIG. 3 illustrates the position of pile driving apparatus 8 and subframe 9 in relation to each other at the beginning of the process of pile driving. The subframe is held off a distance 30 from the pile driving apparatus, said distance being required in view of the movement of the ship 1 in a seaway.

FIG. 4 shows the position of subframe 9 and pile driving apparatus 8 with respect to each other after covering a distance 31, which forms part of the complete distance to be covered during pile driving.

During the pile driving process the subframe is stationary and it is therefore possible to connect a new tube section 12 to the upper end of the tube string without interrupting the process. When the position illustrated in FIG. 4 has been reached with a distance 30' between the subframe 9 and the pile driving apparatus 8, said distance being required for movements of the ship, it is then possible to bring the subframe again into the position shown in FIG. 3 without interrupting the pile driving process.

What is claimed is:

1. In an apparatus for underwater pile driving at substantial depths including a ship having a lifting device and cable handling means, a submersible subframe, means for suspending the subframe from the lifting device, cables connected to a pile to be driven and running down from the cable handling means, and a pile driving head guided on the cables and vertically reciprocable in the subframe, the improvements characterized by:

a. the means for suspending the subframe comprising a string of connected, substantially rigid tube sections, said means for suspending the subframe minimizing twisting of the subframe and pile driving head, b. a plurality of conduits secured to the string for communicating hydraulic, pneumatic and electrical energy to and from the subframe.

c. first flexible hose means coupled to said conduits at lower ends thereof for conveying the energy from the conduits to the pile driving head, and d. second flexible hose means coupled to said conduits at upper ends thereof for conveying the energy from sources on the ship to the conduits, said second flexible hose means being coupled to the upper end of the conduits at a point below the point of suspension of the tube string from the lifting device and having a length adapted to the length of the pile to be driven.

2. An apparatus as defined in claim 1, wherein the connection between the second hose means and the conduits secured to the tube string comprises a coupling piece included in the tube string.

3. A method of continuous submerged pile driving comprising:

a. suspending a pile from cables on a ship, b. lowering the pile to the sea bottom by paying out the cables, c. reciprocably mounting a pile driving head within a subframe, d. lowering the subframe until the pile driving head engages the pile, with the pile driving head being guided on the cables in its descent, by sequentially connecting a plurality of substantially rigid tubing sections together in a continuous string, with the lower section being connected to the subframe and the upper section being suspended from lifting means on the ship, said tubing sections carrying conduit means for communicating power to the pile driving head, e. coupling a connecting piece for the conduit means in the upper end of the tube string below its point of suspension from the lifting means, f. coupling flexible power supply hoses to the connecting piece, the length of said hoses being at least equal to one half the length of the pile, g. commencing the pile driving by reciprocating the pile driving head within the subframe, and h. connecting additional tubing sections into the string above the connecting piece as the pile driving progresses, whereby power is continuously supplied to the pile driving head via the flexible power supply hoses and conduit means, and the pile driving may therefore continue uninterrupted as the additional tubing sections are connected into the string.

4. A method as in claim 3 wherein steps (b) and (d) are performed simultaneously.

5. A method as in claim 3 wherein step (h) is performed by:

a. securing the upper end of the tube string to support means on the ship, b. disconnecting the lifting means from the tube string, c. connecting an additional tubing section into the string, d. connecting the lifting means to the added tubing section, and e. releasing the upper end of the tube string from the support means.

6. In an apparatus for underwater pile driving at substantial depths including a ship having a lifting device and cable handling means, a submersible subframe, means for suspending the subframe from the lifting device, cables connected to a pile to be driven and running down from the cable handling means, and a pile driving head guided on the cables and vertically reciprocable in the subframe, the improvements characterized by:

a. the means for suspending the subframe comprising a string of connected, substantially rigid tube sections, whereby the twisting of the subframe and pile driving head is minimized, b. a plurality of conduits secured to the string for communicating hydraulic, pneumatic and electrical energy to and from the subframe, c. first flexible hose means for conveying the energy from the lower end of the conduits to the pile driving head, d. second flexible hose means for conveying the energy from sources on the ship to the upper end of the conduits, said second flexible hose means being coupled to the upper end of the conduits at a point below the point of suspension of the tube string from the lifting device and having a length adapted to the length of the pile to be driven, and e. a coupling piece included in the tube string having connecting members within valves therein, said coupling piece comprising the connection between the second hose means and the conduits.

7. An apparatus as defined in claim 6, wherein laterally oriented roller paths are provided on the ship for guiding the second hose means.

8. In an apparatus for underwater pile driving at substantial depths including a ship having a lifting device and cable handling means, a submersible subframe, means for suspending the subframe from the lifting device, cables connected to a pile to be driven and running down from the cable handling means, and a pile driving head guided on the cables and vertically reciprocable in the subframe, the improvements characterized by:

a. the means for suspending the subframe comprising a string of connected, substantially rigid tube sections, whereby the twisting of the subframe and pile driving head is minimized, b. a plurality of conduits secured to the string for communicating hydraulic, pneumatic and electrical energy to and from the subframe, c. first flexible hose means for conveying the energy from the lower end of the conduits to the pile driving head, d. second flexible hose means for conveying the energy from sources on the ship to the upper end of the conduits, said second flexible hose means being coupled to the upper end of the conduits at a point below the point of suspension of the tube string from the lifting device and having a length adapted to the length of the pile to be driven, and e. laterally oriented roller paths disposed on the ship for guiding the second hose means.

9. In an apparatus for underwater pile driving at substantial depths including a ship having a lifting device and cable handling means, a submersible subframe, means for suspending the subframe from the lifting device, cable connected to a pile to be driven and running down from the cable handling means, and a pile driving head guided on the cables and vertically reciprocable in the subframe, the improvements characterized by:

a. the means for suspending the subframe comprising a string of connected, substantially rigid tube sections, whereby the twisting of the subframe and pile driving head is minimized, b. a plurality of conduits secured to the string for communicating hydraulic, pneumatic and electrical energy to and from the subframe, c. first flexible hose means for conveying the energy from the lower end of the conduits to the pile driving head, d. second flexible hose means for conveying the energy from sources on the ship to the upper end of the conduits, said second flexible hose means being coupled to the upper end of the conduits at a point below the point of suspension of the tube string from the lifting device and having a length adapted to the length of the pile to be driven, e. a coupling piece included in the tube string, said coupling piece comprising the connection between the second hose means and the conduits secured to the tube, and f. laterally oriented roller paths are provided on the ship for guiding the second hose means.

* * * * *